United States Patent [19]

Pavnica

[11] Patent Number: 4,488,391

[45] Date of Patent: Dec. 18, 1984

[54] CENTERING CLIPS FOR WINDOW FRAMES

[76] Inventor: Joseph Pavnica, 311 S. Midland Ave., Joliet, Ill. 60436

[21] Appl. No.: 217,473

[22] Filed: Dec. 17, 1980

Related U.S. Application Data

[63] Continuation of Ser. No. 090,165, Oct. 31, 1979.

[51] Int. Cl.[3] ..... E06B 1/56

[52] U.S. Cl. ..... 52/741; 52/211; 52/213; 52/714

[58] Field of Search ..... 52/214, 217, 213, 211, 52/212, 714, 741

[56] References Cited

U.S. PATENT DOCUMENTS

| | | | |
|---|---|---|---|
| 1,570,351 | 1/1926 | Hultin | 52/214 |
| 2,226,254 | 12/1940 | Owen | 52/217 X |
| 2,722,170 | 11/1955 | Broberg | 49/463 X |
| 2,840,203 | 6/1958 | Hehr | 52/214 X |
| 2,902,727 | 9/1959 | Samolis | 52/214 |
| 3,378,973 | 4/1968 | Tudor-Pole | 52/714 X |
| 3,788,019 | 1/1974 | Kiselewski | 52/214 |

*Primary Examiner*—Alfred C. Perham

*Attorney, Agent, or Firm*—Ernest Kettelson

[57] ABSTRACT

A centering clip for window frames, comprising an element of spring metal to provide a resilient clip, having a base portion attached to the top edge of a window frame, and inclined portion integrally formed with the base portion at an acute angle, with the inclined portion having a row of teeth along the free end. When the window frame is inserted into the mounting opening or mounting frame, the inclined portion of the resilient clip engages the top edge of the mounting frame and is compressed when the window frame is inserted. The row of teeth at the free end of the centering clip bites into the top edge of the mounting frame and holds the window frame against removal until the centering clip is depressed to disengage the teeth from the top edge of the mounting frame. The window frame is thus held within the mounting frame until a workman is able to nail the window frame in place. The resilience of the centering clip allows the workman to move the window frame within the mounting frame both laterally and longitudinally small distances in order to properly center. A pair of such centering clips is preferably used, both attached to the same edge of the window frame.

3 Claims, 11 Drawing Figures

CENTERING CLIPS FOR WINDOW FRAMES

This is a continuation of application Ser. No. 090,165, filed Oct. 31, 1979.

BACKGROUND OF THE INVENTION

This invention relates to the field of spring clips for temporarily securing window frames within prepared openings or mounting frames in which the window frames are to be permanently installed.

Most previous spring clips of this kind have been of the permanent construction type in which the spring clips or other devices are included as part of the permanent fastening apparatus which keeps the window frame in place. The present invention is directed to fastening clips which are intended merely to function as temporary retaining means until a workman is able to permanently secure the window frame in place. Prior to this invention, a carpenter would require assistance in centering a window frame within the mounting opening to prevent it from falling out or from moving out of center until he was able to nail the window frame permanently in place. This invention enables a single carpenter to insert the window frame into the mounting opening whereupon the centering clips engage the upper edge of the mounting opening and prevent the window frame from falling out after the carpenter has removed his hands from the frame. His hands are then free to obtain hammer and nails to nail the window frame in the desired location, and prior thereto to shift the window frame both up and down as well as sideways within the mounting opening. If it is desired to remove the window frame from the opening after an initial temporary insertion, the centering clips can be depressed from the rear by means of an appropriate tool or even by manually depressing the inclined portion of the centering clips to disengage from the top edge of the mounting frame.

SUMMARY OF THE INVENTION

It is an object of the invention to provide a centering clip for window frames to temporarily retain the the window frame within a mounting opening until it can be permanently secured therein.

It is an object of the invention to provide a centering clip for a window frame, comprising a base portion for nailing or otherwise securing to an edge of a window frame, the clip being of resilient metal, said clip including an inclined portion integrally formed with and extending from said base portion, and a plurality of teeth formed along the free edge of said inclined portion.

It is an object of the invention to provide a centering clip for window frames, having cam means for depressing the centering clip when the window frame is inserted into a mounting opening, said cam means being normally biased towards securing engagement with a surface of the mounting frame to hold the window frame in place until the said cam means are released.

DESCRIPTION OF PREFERRED EMBODIMENTS

Figure 1:
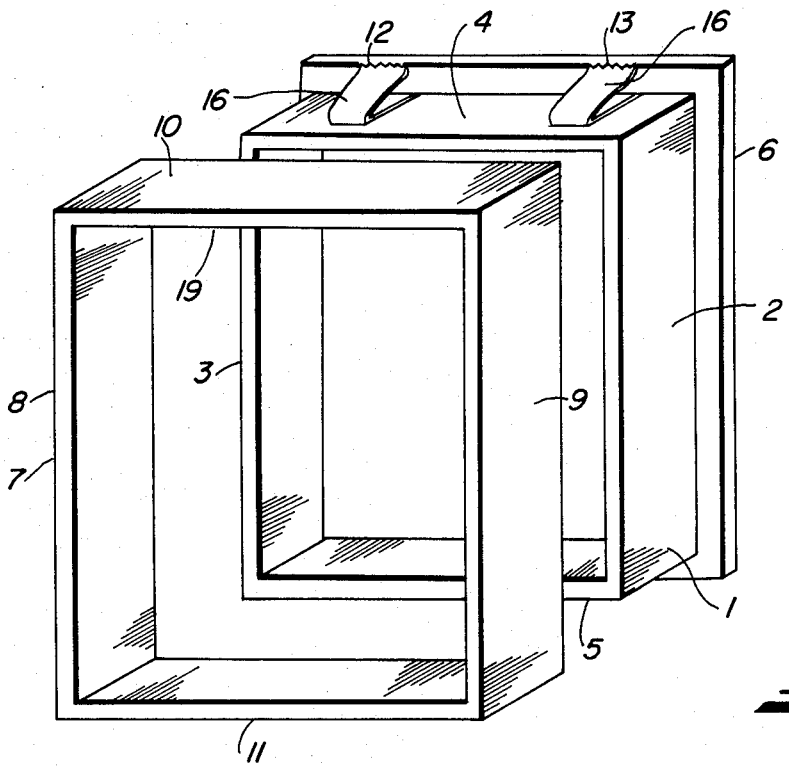
FIG. 1 is a perspective view of a window frame having centering clips in accordance with this invention attached to the top edge and aligned with a mounting frame in which the window frame is to be inserted.
Figure 2:
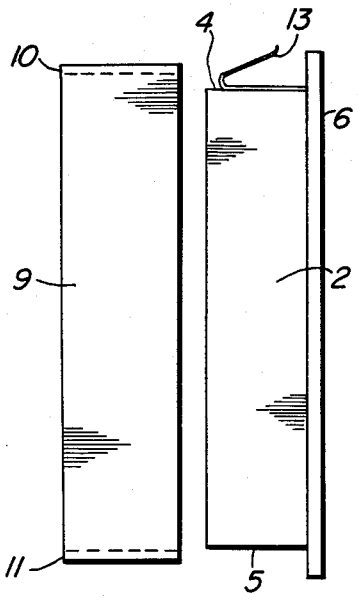
FIG. 2 is a side elevation view of a window frame having centering clips in accordance with this invention mounted on the top edge, the window frame being spaced apart in front of a mounting frame and aligned therewith for insertion therein.
Figure 3:
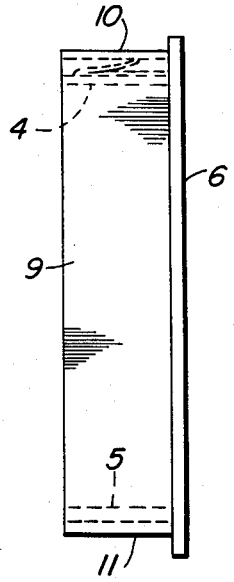
FIG. 3 is a side elevation view of the window frame and mounting frame of FIG. 2, in which the window frame has been fully inserted into the mounting frame, the inserted and covered portions being shown in broken lines.
Figure 4:
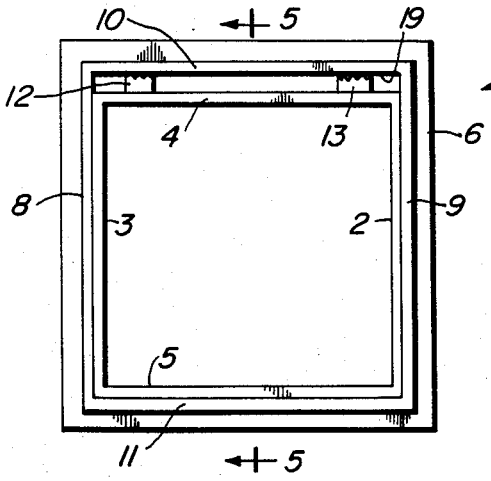
FIG. 4 is a rear elevation view of a window frame having centering clips in accordance with this invention inserted into a mounting frame with the centering clips engaging the top edge of the mounting frame.
Figure 5:
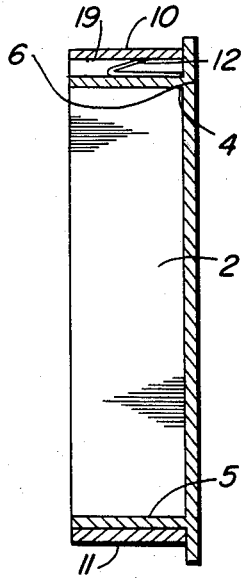
FIG. 5 is a section view taken on line 5—5 of FIG. 4.
Figure 6:
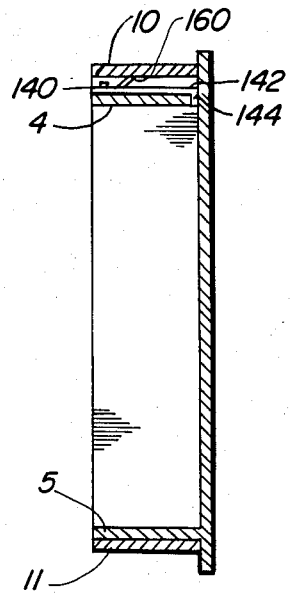
FIG. 6 is a section view similar to FIG. 5 in which a modified form of centering clip is shown.
Figure 7:
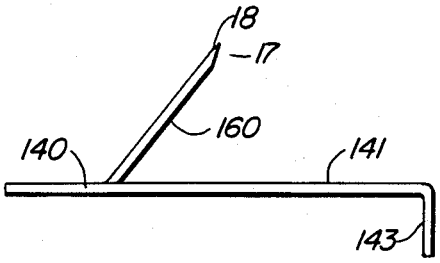
FIG. 7 is a side elevation view of a modified centering clip as shown in FIG. 6.
Figure 8:
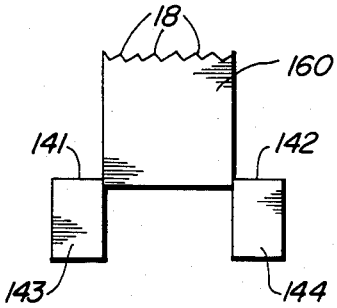
FIG. 8 is a front elevation view of the modified centering clip shown in FIG. 7.
Figure 9:
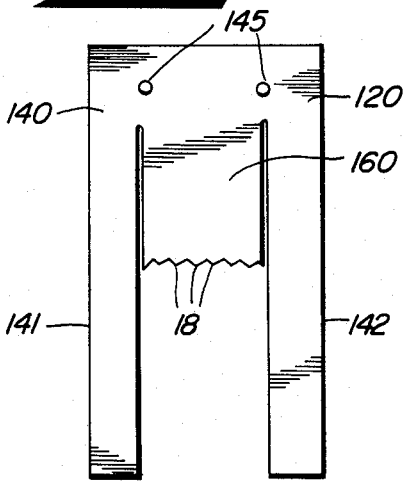
FIG. 9 is a top plan view of the modified form of centering clip shown in FIGS. 7 and 8.
Figure 10:
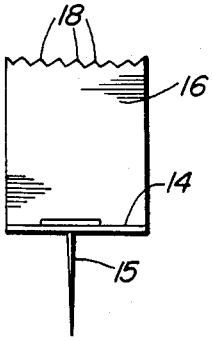
FIG. 10 is a side elevation view of the centering clip in accordance with this invention shown in FIGS. 1-5.
Figure 11:
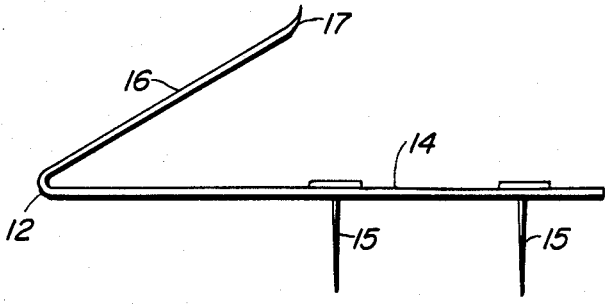
FIG. 11 is a front elevation view of the centering clip of FIG. 10.

A window frame 1 includes a pair of relatively long side walls 2 and 3, and a pair of relatively shorter end walls 4 and 5 which join the side walls 2 and 3 at each opposite end. Window frame 1 also includes a peripheral border 6 secured to the front edge of the side walls 2 and 3 and end walls 4 and 5. The border 6 provides an overhang extending outwardly around the periphery of the side and end walls of the window frame 1.

A mounting frame 7 is provided to receive therein the window frame 1. The mounting frame 7 also includes a pair of relatively long side walls 8 and 9 and a pair of end walls 8 and 9 at each opposite end.

The window frame 1 and mounting frame 7 are ordinarily of wood, although other materials may be used. The length of side walls and end walls of the mounting frame 7 is somewhat greater than the corresponding length of the side walls and end walls of the window frame 1, so when the window frame 1 is inserted into the mounting frame 7, the window frame 1 can be moved up and down short distances as well as from side to side short distances in order to properly center. However, since there is relative movement between the window frame 1 and the mounting frame 7, it is possible for the window frame 1 to fall out of the mounting frame 7 after being inserted, if the carpenter or other workman removes his hand from the window frame. Therefore, in accordance with this invention, centering clips 12 and 13 are provided, and are secured in the present embodiment of the invention along the top wall 4 of the window frame 1 as shown in FIG. 1. The centering clips 12 and 13 could be placed along the bottom wall 5 if desired, or even along one or the other of the side walls 2 or 3 of the window frame 1.

Each of the centering clips 12 and 13 are identical in construction so only one will be described in detail. The centering clip 12 includes a base portion 14, comprising a flat planar length of metal having spring characteristics, the base portion being no longer than the width of the top wall 4 of the window frame 1. The base portion 14 may be shorter than the width of top wall 4. The base portion 14 includes a pair of apertures through which tacks or nails 15 may extend for driving into the top wall 4 of the window frame 1 to secure the centering clip in place thereon. The apertures are preferably located in the forward portion of the base 14 to provide clearance to contact the heads of the nails or tacks 15 with a hammer.

Integrally connected with the base portion 14 is an inclined portion 16 which extends from the base portion 14 in a plane which intersects base 14 at an acute angle. The inclined portion 16 of the clip 12, therefore, provides a cam surface for contact with the corresponding top wall 10 of the mounting frame 7 when the window frame 1 is inserted therein. As window frame 1 is inserted into mounting frame 7, the inclined portion 16 of clip 12 becomes further compressed until it is bent substantially back on itself with the inclined portion 16 almost parallel with the surface of the base 14. The free end 17 of the clips includes a plurality of teeth 18 along the top edge thereof. Thus, when the window frame 1 is inserted into the mounting frame 7, and the inclined portion 16 is cammed against the top wall 10 of the mounting frame 7, it becomes deflected until it is almost parallel with the base 14. The teeth 18 at such time bear against and engage the inward facing surface 19 of the top wall 10 of mounting frame 7. The free end 17 of inclined portion 16 is curved outwardly slightly to enable the teeth 18 to better engage the inner surface 19 of the top wall 10 of the mounting frame 7. Since the plane of the inclined portion 16 of clip 12 forms an acute angle with the inner surface 19 of the top wall 10 of mounting frame 7 facing in the direction of insertion, the clip 12 is able to move inwardly of the mounting frame 7, but its teeth 18 engage the inner surface 19 of top wall 10 in such a way as to prevent removal of the window frame 1 from the mounting frame 7. Attempts to move the top portion of window frame 1 outwardly from the mounting frame 7 will cause the teeth 18 of the clip 12 to bete more firmly into and engage the inner surface of top wall 10 of mounting frame 7 more securely, having a "fish hook effect".

The centering clips 12 and 13 may be mounted on additional walls of the window frame 1 such as the side walls 2 and 3 and the bottom wall 5. However, in accordance with this invention it is not necessary to provide centering clips on more than one of the peripheral walls of the window frame 1.

The dimension of the inclined portion 16 of the centering clips 12 and 13 is such that when undeflected, the free end 17 and teeth 18 are spaced from the plane of base 14 a distance which is at least as great as the difference in length between the longer side walls 8 and 9 of the mounting frame 7 and the length of the shorter walls 2 and 3 of the window frame 1. By providing the centering clips 12 and 13 with inclined portion 16 of such dimension, when the window frame 1 is fully inserted into the mounting frame 7, the free end 17 and teeth 18 of the inclined portion of the centering clips 12 and 13 firmly engages the inner surface 19 of the top wall 10 of the mounting frame 7 while at the same time the bottom wall 5 of window frame 1 rests snugly against the bottom wall 11 of mounting frame 7. When in such position, the window frame 1 may still be moved upwardly towards the top wall 10 of mounting frame 7 against the bias of the resilient inclined portion 16, but the biasing force of inclined portion 16 causes the bottom wall 5 of window frame 1 to normally bear against bottom wall 11 of mounting frame 7 to keep the window frame 1 securely in place until the carpenter or other workman is able to nail the window frame 1 for installation.

A modified form of centering clip is shown in FIGS. 6–9. The modified form of centering clip 120 includes a base portion 140 having a pair of forwardly extending arms 141 an 142 having at their free ends depending flanges 143 and 144. An inclined portion 160 extends upwardly from the base 140 in a plane which intersects the plane of base 140 at an obtuse angle rearwardly and at an acute angle forwardly towards the free ends of extending arms 141 and 142. The inclined portion 160 includes a free end 17 having teeth 18 across the top edge for contact with the inner surface 19 of top wall 10 of mounting frame 7 as previously described.

The base portion 140 of the modified centering clip 120 includes a pair of apertures 145 to receive a pair of nails or tacks to secure the base 140 to the top wall 4 of a window frame 1. The depending flanges 143 and 144 may be forced downwardly between the front edge of the top wall 4 of the window frame 1 and the border strip 6, which thereby assists in holding the centering clip 120 in place.

To use the centering clips of this invention, a carpenter or other workman will first nail or otherwise secure one or more of the centering clips 12 and 13, or 120, to the top wall 4 of the window frame 1 with the inclined portion 16, or 160, extending in a plane which intersects the plane of the top wall 4 of window frame 1 at an acute angle facing toward the front edge of the window frame to which the border 6 is secured. The window frame 1 is then inserted into the opening of mounting frame 7 with the bottom wall 5 of window frame 1 resting against the bottom wall 11 of the mounting frame 7, and with the teeth 18 of free end 17 of the inclined portion 16 engaging the inner surface 19 of the top wall 10 of the mounting frame 7. The workman continues to insert the window frame 1 until it has been fully inserted and the border strip 6 of window frame 1 abuts against the corresponding facing edges of the sidewalls 8 and 9 and end walls 10 and 11 of the mounting frame 7. At such time the window frame 1 is held within the mounting frame 7 in such a manner that it will not fall out inasmuch as the teeth 18 of inclined portion 16 of the centering clips bite into and engage the inner surface 19 of top wall 10 of the mounting frame 7. The workman is now free to release the window frame 1, whereupon he is able to use both of his hands to obtain hammer and nails or other permanent fastening elements in preparation for permanently securing the window frame in place. After obtaining such hammer and nails or other equipment, the workman can then move the window frame upwardly and downwardly, and from side to side, as desired within the mounting frame 7 to properly center and true-up the window frame prior to permanently installing. Once the workman is satisfied that the window frame is in its proper location with the centering clips assisting in maintaining the window frame in such position, he is then free to use both hands to nail or otherwise secure the window frame to the mounting frame, thereby completing installation of the window.

After the window frame 1 has been inserted into the mounting frame 7 with the centering clips engaging the inner surface 19 of top wall 10 of mounting frame 7, if it is desired to remove the window frame 1, the workman may insert a pry-bar or other tool against the inclined portion 16 of the centering clips to depress the inclined portion enough to release the teeth 18 from engagement with the inner surface 19 of the top wall 10. At such time the window frame 1 may then be removed from the mounting frame 7.

I claim:

1. The method of installing a window frame in a mounting aperture, comprising the steps of selecting a window frame of appropriate size for mounting in said mounting aperture with room for moving said window frame small distances upwardly and downwardly as well as from side to side when initially inserted into said mounting aperture to center said window frame within said mounting aperture, selecting at least one spring clip having a base for anchoring to an end wall of said window frame and having a resilient member extending diagonally from said base whose free end includes engagement means spaced apart from said base a distance at least equal to the dimension by which said mounting aperture is greater than said window frame in said upward and downward direction, anchoring said base of said clip to one of the top and bottom walls of said window frame with the said free end of said resilient member slanting diagonally outwardly and away from the direction in which said window frame is to be inserted into said mounting aperture, inserting said window frame into said aperture, causing said free end of said resilient member of said spring clip to engage the corresponding facing portion of said mounting aperture with the opposite end wall of said window frame abutting against the corresponding portion of said mounting aperture which faces said opposite end wall of said window frame, letting go of said window frame to obtain tools and equipment for permanently securing said window frame in a mounting aperture allowing said spring clip in engagement with a portion of said mounting aperture to temporarily retain said window frame therein, and permanently connecting said window frame in said mounting aperture.

2. The method of installing a window frame in a mounting aperture as set forth in claim 1, including the additional step of adjusting said window frame in one of the directions upwardly, downwardly and sideways against the bias of said spring clip in engagement with a portion of said mounting aperture to center said window frame in a desired position before permanently securing within said mounting aperture.

3. The method of installing a window frame in a mounting aperture as set forth in claim 1, including the additional step of selecting an additional one of said spring clips and anchoring to said one of said top and bottom end walls of said window frame to which said other spring clip is anchored.

* * * * *